United States Patent [19]

Skrzypek

[11] 4,278,126

[45] Jul. 14, 1981

[54] HEAT EXCHANGER FOR FURNACE FLUE

[76] Inventor: Frank M. Skrzypek, 50682 Bower Dr., New Baltimore, Mich. 48047

[21] Appl. No.: 146,475

[22] Filed: May 5, 1980

[51] Int. Cl.[3] ..... F28D 7/10

[52] U.S. Cl. ..... 165/122; 165/156; 165/DIG. 2; 237/55

[58] Field of Search ..... 165/DIG. 2, 122, 156, 165/154; 237/55

[56] References Cited

U.S. PATENT DOCUMENTS

| | | | |
|---|---|---|---|
| 1,196,546 | 8/1916 | Jacobson | 165/156 |
| 2,274,341 | 2/1942 | Mueller | 237/55 |
| 2,468,909 | 5/1949 | Yeager et al. | 165/DIG. 2 |
| 2,756,032 | 7/1956 | Dowell | 165/156 |
| 2,879,976 | 3/1959 | Rose, Sr. | 165/122 |
| 3,124,197 | 3/1964 | Funk | 165/122 |

*Primary Examiner*—Sheldon J. Richter
*Attorney, Agent, or Firm*—Gifford, VanOphem, Sheridan & Sprinkle

[57] ABSTRACT

A heat exchanger comprising an elongated tubular housing having an inlet at one end and an outlet at its other end is secured around and spaced from the furnace flue by a plurality of plates secured around the furnace flue. The plates are provided with apertures to permit air flow past the plates. The apertures in each plate are angularly displaced with respect to the apertures of an adjacent plate such that the air circulates around the furnace flue as the flow continues from the inlet to the outlet of the elongated housing. An air pump produces a flow of pressurized air into the inlet of the housing to create a flow of pressurized air through the housing from the inlet toward the outlet of the housing.

9 Claims, 6 Drawing Figures

HEAT EXCHANGER FOR FURNACE FLUE

BACKGROUND OF THE INVENTION

1. Field of the Invention

The present invention relates generally to an apparatus for exchanging heat and, more particularly, to such a device which transfers the heat normally lost from a furnace flue for use in heating a room or building structure.

2. Description of the Prior Art

Furnace flues, which exhaust combusted gases from a heating furnace, have long been known to waste heat energy contained within the gases. Technically, the flue exhausts the gases directly from the furnace to a location outside the building so that the poisonous and volatile gases do not become mixed with the ventilating air passing through the building heating system. However, these gases contain a large amount of heat energy which is thus not efficiently used to provide warmth for the ventilating air. Consequently, much of the energy used to create the heat is wasted. Although, a certain amount of heat in the gases passing through the flue heats up the flue pipe, the radiation into the surrounding air from the flue is negligible and thus fails to conserve much of the heat energy passing through the flue.

One previously known device for transferring additional heat from the gases in the flue to the ventilator air is shown in U.S. Pat. No. 4,176,787 to Gary. Gary discloses a flue pipe construction in which a portion of the furnace flue extends across the ventilator duct of the ventilator system. The portion of the flue passing through the cold air return shaft includes internal obstructions which absorb the heat from the gases passing through the flue and thus retain the heat and prolong its contact with the air passing through the ventilator duct. Such a system is disadvantageous in that it obstructs the flow of noxious gases in the flue and increases the risk that these gases will escape through leaks in the ventilation system.

Another known type of device comprises a plurality of air passage tubes which extend through the flue such that the tubes and air passing through them are subjected to the heat energy of the flue gases passing around the tubes. Such a construction also increases obstruction to the flow of the noxious gases flowing through the flue. In addition, since the air flow through the tubes is substantially in a straight line, the air within the tubes is unable to absorb a large amount of heat energy in the short time that the air is passing through the tube.

Another known type of the heat exchange unit is disclosed in U.S. Pat. No. 4,155,505 to Young. Young discloses the use of a plurality of heat exchanging fins secured to the furnace flue and enclosed within an insulated enclosure. A fan within the enclosure causes circulation of the air within the enclosure. The air flow passes over one end of a closed circuit expansion/compression refrigeration system whose hot end extends outside of the enclosure and is disposed within a vented cabinet. A second fan in the vented cabinet causes ventilation air to flow over the hot end of the refrigeration system to transfer the heat energy to the ambient air. Such a unit is disadvantageous in that it is structurely complicated and accordingly very expensive. Since the device involves the use of two fans as well as a compressor and an expander to transfer the heat energy from the enclosure to the vented cabinet, the unit itself requires a large input of energy in order to operate the system. Thus, the device is not only expensive to build but also expensive to operate. Consequently, the system does not efficiently conserve energy.

SUMMARY OF THE PRESENT INVENTION

The present invention overcomes the above mentioned disadvantages by providing a heat exchange unit which is easy to install around an existing flue and which permits ventilating air to absorb heat energy by both conduction and convection so that a greater amount of heat energy is absorbed than previously known heat exchangers. The device enables ventilator air to circulate around the furnace flue so that a large portion of the furnace flue is in contact with the ventilating air. In addition, a plurality of plates are in contact with the flue so that heat energy can be conducted from the flue and radiated to the ventilator air passing around the flue.

The device generally comprises a housing defining an enclosed chamber secured around a portion of the furnace flue, and preferably, along the entire length of the exposed portion of the furnace flue. A plurality of plates are secured to and spaced along the furnace flue within the enclosure and extend outwardly toward the inner walls of the housing enclosure. The plates are provided with apertures arranged in a predetermined pattern to permit a circular pattern of air flow around the furnace flue.

The housing enclosure includes an air inlet and air outlet so that an air pump can be secured to the housing and force a flow of air through the enclosure from the inlet to the outlet. Preferably, the pump provides a pressurized flow of air into the inlet so that the pressure of the ventilating air through the enclosure exceeds the pressure of the gases within the flue. Consequently, in the event that a leak develops in the furnace flue, the pressure within the enclosure forces noxious gases to remain within the flue to be expelled from the heating system.

BRIEF DESCRIPTION OF THE DRAWING

The present invention will be more clearly understood by reference to the following detailed description when read in conjunction with the accompaying drawing, in which like reference characters refer to like parts throughout the several views, and in which.

DETAILED DESCRIPTION OF A PREFERRED EMBODIMENT OF THE PRESENT INVENTION

Figure 1:
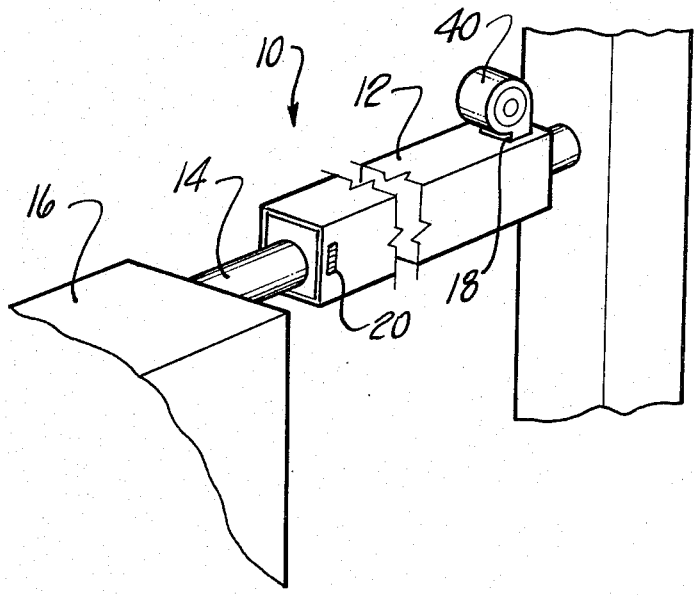
FIG. 1 is a broken perspective view of a preferred embodiment of the heat exchanger of the present invention shown secured to a furnace flue.

Referring now to FIG. 1, the present invention 10 is thereshown comprising a housing 12 secured around a furnace flue 14 which is connected at its inlet to extend outwardly from a furnace 16. The housing 12 includes an air inlet 18 at one end an has an air outlet 20 at the other end.

Figure 2:
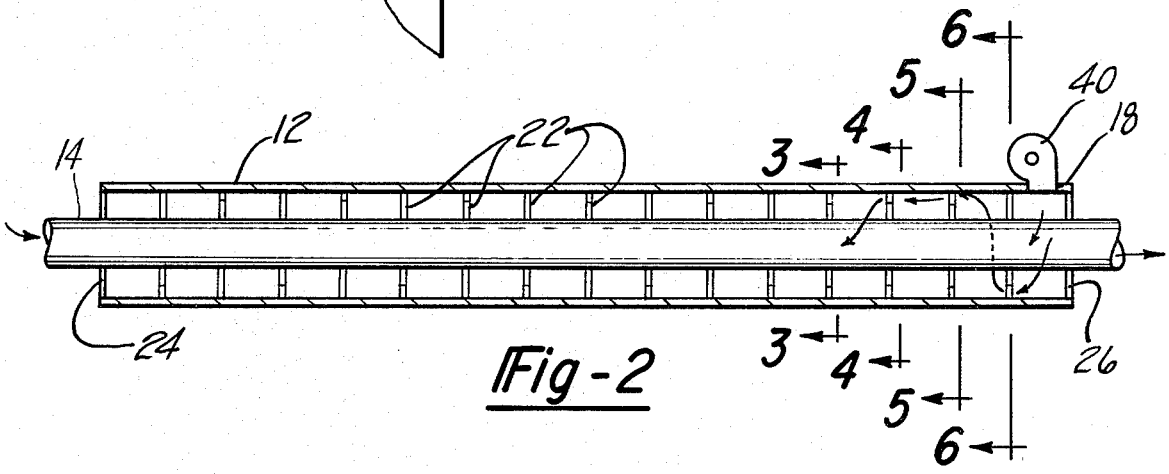
FIG. 2 is a sectional elevation of the heat exchanger shown in FIG. 1.
Figure 3:
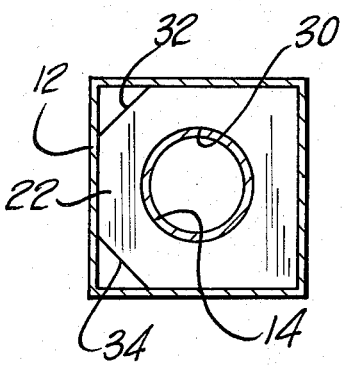
FIG. 3 is a cross-sectional view of the heat exchanger taken substantially along the line 3—3 in FIG. 2.

As best shown in FIG. 2, the housing 12 is secured around the flue 14 by a plurality of spaced plates 22 and end plates 24 and 26. The plates 22, 24 and 26 increase the heat absorbing capability of the heat exchanger as they are physically secured to or in contact with both the furnace flue and the housing 12 and thereby transfer the heat by conduction from the furnace flue 14. All of the plates 22 are perferably disposed between the inlet 18 and the outlet 20 of the housing 12.

As shown in FIGS. 3 through 6, the housing 12 is square in cross section. Accordingly, the plates 22 are substantially square so that substantially the entire periphery of each plate 22 engages the inner periphery of the housing 12. Each plate 22 is provided with a central aperture 30 in which the furnace flue 14 is received. In addition, each plate 22 includes two truncated corner portions 32 and 34. The truncated corners 32 and 34 define a pair of flow passages past each plate 22.

As shown in the drawings, each pair of truncated corners 32 and 34 of each plate 22 are rotated 90 degrees with respect to the pair of truncated corners of the adjacent plate 22 whereby the truncated corner 32 of one plate registers with the truncated corner 34 of the preceding plate and the truncated corner 34 of the plate registers with a truncated corner 32 of the succeeding plate. The angular displacement of the air passages through adjacent plates provides a circular flow of air around the flue substantially as shown in FIG. 2 when air is forced longitudinally through the housing 12.

The air flow is preferably provided by air pump 40 which provides a pressurized flow of air at the inlet 18. Since the end plate 26 engages the outer periphery of the flue and the inner periphery of the housing 12 to enclose the chamber, the pressurized air is forced to flow through the air passages provided by the truncated corners 32 and 34 of the first plate 22. A portion of the air passing through the aperture 34 of the first plate passes through the passage formed by truncated corner 32 of the second plate shown in FIG. 5. The air passing through the passage provided by truncated corner 32 of the firstplate impinges upon the second plate 22 shown in FIG. 5 and the flue 14. The pressurized air absorbs heat from the flue 14, plate 22 and the housing 12 before passing through the passages at truncated corners 32 and 34 of the second plate shown in FIG. 5.

Figure 4:
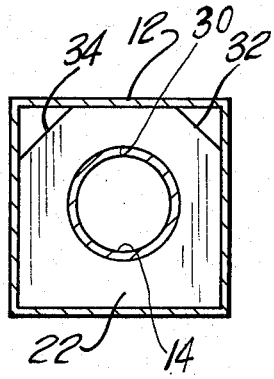
FIG. 4 is a cross-sectional view taken substantially along line 4—4 in FIG. 2.
Figure 5:
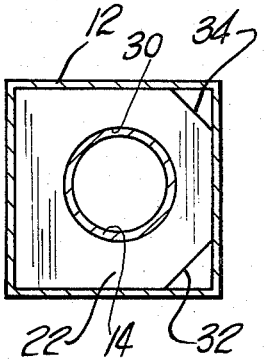
FIG. 5 is a cross-sectional view taken substantially along line 5—5 in FIG. 2.
Figure 6:
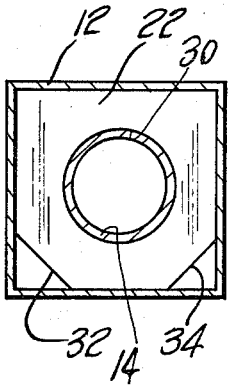
FIG. 6 is a cross-sectional view taken substantially along the line 6—6 in FIG. 2.

Although a portion of the air flowing past truncated corner 34 of the plate 22 shown at FIG. 5, passes directly through the passage 32 of the third plate 22 shown in FIG. 4, the remainder of the air passing past the second plate impinges upon the third plate 22, the inner walls of the housing 12 and the periphery of the furnace flue 14. This impingement and angular displacement of air flow continues throughout the length of the housing 12 and causes the air flow through the housing to circulate about the furnace flue 14 as the air passes from the inlet 18 to the outlet 20 of the housing.

It is to be understood that the detailed description of the preferred embodiment of the present invention is not intended to limit the scope of the present invention. For instance, the air flow through the housing 12 could be provided by securing a vacuum pump to the outlet 20, whereby air is drawn into the inlet 18 at the opposite end of the housing 12. However, applicant's preferred embodiment includes a positive pressure pump 40 so that the pressure within the housing 12 exceeds the pressure of the gases flowing within the flue 14. Thus, in the event that a leak develops in the flue 14 within the housing 12, the pressurized air flow produced by the pump 40 prevents the noxious gases within the flue from being mixed with the air passing through the housing 12. Moreover, the housing 12 and the plates 22 need not be square as long as the air passages through one plate are angularly displaced with respect to the air passages of an adjacent plate.

Nevertheless, since the plates 22 are in substantial contact with the flue 14 and the housing 12, much of the heat from the gases in the flue are conducted to these members and radiated therefrom. Since the area of the housing is substantially larger than the area of the flue 14, substantially more heat can be radiated outwardly to the ambient air from the housing 12. In addition, a circular pattern of air flow through the housing 12 increases the heat absorption rate by prolonging the time in which the ventilating air passing through the housing impinges upon the heat exchange element. Consequently, heat transfer from the gases in the flue is faster and more efficient than previously known heat exchangers of simple construction.

Having thus described my invention, many modifications thereto will become apparent to those skilled in the art to which it pertains without departing from the scope and spirit of the invention as defined in the appended claims.

What is claimed is:

1. A heat exchanger for recapturing and recirculating heat usually lost from a furnace flue, said heat exchanger comprising:

an elongated tubular housing including opposed end walls with an aperture in each end wall dimensioned to receive the furnace flue therethrough, and having an inlet near one end and an outlet near its other end, said housing defining a flow chamber surrounding said flue;

first means for producing an air flow axially through said chamber from said inlet to said outlet;

second means for directing the air flow about the flue, within the chamber as the air flow passes through said chamber; and wherein said second means comprises a plurality of axially spaced plates extending transversely across said chamber, each of said plates having at least one eccentrically aligned aperture, said at least one aperture of each plate being arcuately displaced by an amount substantially less than 180° and in a predetermined direction of rotation with respect to said at least one aperture of its adjacent upstream plate whereby said air flows through said housing in a substantially helical path around the flue.

2. The invention as defined in claim 1 wherein said end walls sealingly engage the flue about its periphery.

3. The invention as defined in claim 1 wherein said tubular housing is square in cross section.

4. The invention as defined in claim 3 wherein the outer periphery of said plates substantially coincides with the inner periphery of said housing, and further wherein each of said at least one aperture is defined by a truncated corner of said plate.

5. The invention as defined in claim 4 wherein said at least one aperture comprises two apertures.

6. The invention as defined in claim 1 wherein said first means comprises a pump secured to said inlet whereby the pressure of the air flow is greater than the pressure of gases in the flue.

7. The invention as defined in claim 1 wherein said first means comprise a vacuum pump secured to said outlet.

8. A heat exchanger for recapturing an recirculating heat usually lost from a furnace flue, said heat exchanger comprising:

an elongated tubular housing having a square cross sectional shape and including opposed end walls with an aperture in each end wall dimensioned to receive the furnace flue therethrough, and having an inlet near one end and an outlet near its other end, said housing defining a flow chamber surrounding said flue;

first means for producing an air flow axially through said chamber from said inlet to said outlet; and second means for directing the air flow in a circular path about the flue, within the chamber as the air flow passes through said chamber;

wherein said second means comprises a plurality of axially spaced plates extending transversely across said chamber, each of said plates having at least one eccentrically aligned aperture, said at least one aperture of each plate being arcuately displaced with respect to said at least one aperture of an adjacent plate, wherein the outer periphery of said plates substantially coincides with the inner periphery of said housing, and wherein each of said at least one aperture is defined by a truncated corner of said plate.

9. The invention as defined in claim 8 wherein said at least one aperture comprises two apertures.

* * * * *

UNITED STATES PATENT AND TRADEMARK OFFICE

CERTIFICATE OF CORRECTION

PATENT NO. : 4,278,126

DATED : July 14, 1981

INVENTOR(S) : Frank M. Skrzypek

It is certified that error appears in the above-identified patent and that said Letters Patent are hereby corrected as shown below:

Column 3, line 1, second occurrence, delete "an" and insert --and-- therefor;

Column 3, line 43, delete "firstplate" and insert --first plate-- therefor;

Column 4, line 19, delete "exchange" and insert --exchanger-- therefor;

Column 5, line 5, delete "an" and insert --and-- therefor.

Signed and Sealed this

*Twentieth* Day of *October 1981*

[SEAL]

*Attest:*

GERALD J. MOSSINGHOFF

*Attesting Officer* *Commissioner of Patents and Trademarks*